US011819747B2

(12) United States Patent
Fedon et al.

(10) Patent No.: US 11,819,747 B2
(45) Date of Patent: Nov. 21, 2023

(54) REBOUNDING DEVICE FOR SPORTS BALL

(71) Applicant: Implus Footcare, LLC, Durham, NC (US)

(72) Inventors: Shane Fedon, Elfin Forest, CA (US); Daniel C. Fuchs, Carlsbad, CA (US); Evan J. Hoffman, Las Vegas, NV (US); Ryan G. Westphal, Carlsbad, CA (US)

(73) Assignee: Implus Footcare, LLC, Durham, NC (US)

( * ) Notice: Subject to any disclaimer, the term of this patent is extended or adjusted under 35 U.S.C. 154(b) by 0 days.

(21) Appl. No.: 17/005,658

(22) Filed: Aug. 28, 2020

(65) Prior Publication Data

US 2021/0060396 A1 Mar. 4, 2021

Related U.S. Application Data

(60) Provisional application No. 62/892,797, filed on Aug. 28, 2019.

(51) Int. Cl.
*A63B 63/00* (2006.01)
*A63B 69/36* (2006.01)

(52) U.S. Cl.
CPC ..... *A63B 63/004* (2013.01); *A63B 2063/001* (2013.01); *A63B 2209/023* (2013.01); *A63B 2210/50* (2013.01); *A63B 2225/09* (2013.01)

(58) Field of Classification Search
CPC ..... A63B 63/004; A63B 2063/001; A63B 2209/023; A63B 2210/50; A63B 2225/09; A63B 63/00; A63B 71/023; A63B 69/0002; A63B 69/0024; A63B 2102/14; A63B 2209/00; A63B 2209/14; A63B 69/002; A63B 2225/093; A63B 69/0097
USPC ..... 473/415, 421, 422, 434, 435, 439
See application file for complete search history.

(56) References Cited

U.S. PATENT DOCUMENTS

| | | | | |
|---|---|---|---|---|
| 2,992,002 A | | 7/1961 | Bingham, Jr. | |
| 3,195,898 A | | 7/1965 | Respini | |
| 3,435,487 A | | 4/1969 | Mazzei et al. | |
| 3,583,703 A | * | 6/1971 | Brown | A63B 63/00 473/456 |
| 3,940,139 A | * | 2/1976 | Barnes | A63B 61/006 473/494 |
| 4,274,632 A | | 6/1981 | Jacobs | |

(Continued)

FOREIGN PATENT DOCUMENTS

| | | |
|---|---|---|
| CN | 102231997 A | 11/2011 |
| CN | 205612980 U | 10/2016 |

(Continued)

OTHER PUBLICATIONS

"Elastic Bungee", Give Go Rebounder, Sep. 9, 2019, 5 pages.

(Continued)

*Primary Examiner* — Nini F Legesse
(74) *Attorney, Agent, or Firm* — Kilpatrick Townsend & Stockton LLP

(57) ABSTRACT

A rebounding device for sports balls including a frame defining a frame opening, a net disposed within the frame opening, a cable extending around a perimeter of the net and a cable tensioning system configured to tension the cable around the perimeter of the net and thereby pull the net taut within the frame opening.

23 Claims, 16 Drawing Sheets

(56) References Cited

U.S. PATENT DOCUMENTS 4,489,941 A 12/1984 Shieh
4,717,157 A 1/1988 Smith
4,776,588 A * 10/1988 Crowley ..... A63B 61/02 473/493
4,973,059 A * 11/1990 Stewart ..... A63B 61/02 473/493
4,986,389 A * 1/1991 Halligan, Sr. ..... E04G 21/28 182/138
5,215,310 A * 6/1993 Allbright ..... A63B 61/02 473/493
5,393,069 A 2/1995 Taylor
5,394,927 A 3/1995 Huebner
5,562,288 A 10/1996 Erkebaev
5,615,889 A 4/1997 Long
5,651,552 A * 7/1997 Whelchel ..... A63B 61/02 473/494
5,810,363 A 9/1998 Saunders et al.
5,833,234 A * 11/1998 Vavala ..... A63B 69/0097 473/434
5,857,679 A * 1/1999 Ringe ..... A63B 69/0097 273/395
6,021,702 A 2/2000 Rexroad
6,213,469 B1 4/2001 Lucio et al.
6,287,220 B1 9/2001 Caruso
6,299,544 B1 10/2001 Schwarzler et al.
6,357,750 B1 3/2002 Lievens
6,461,258 B1 * 10/2002 Vacanti ..... A63B 61/003 473/494
6,482,112 B1 * 11/2002 Betz ..... A63B 71/022 473/421
6,585,610 B2 7/2003 Sompolinsky
6,659,892 B2 12/2003 Lytle et al.
6,739,988 B2 5/2004 Jensen et al.
6,846,253 B1 1/2005 Szwalek
D503,448 S 3/2005 Isom
6,880,828 B2 4/2005 Liao
6,893,364 B1 5/2005 Grunfeld
6,935,971 B2 * 8/2005 Piras ..... A63B 69/002 473/422
D517,620 S 3/2006 Mazloompour
D531,684 S 11/2006 Bouffard et al.
7,223,187 B1 5/2007 Bouffard et al.
7,249,767 B1 7/2007 Gorton
7,264,245 B2 9/2007 Cho
D562,418 S 2/2008 Sifrit
7,455,603 B2 11/2008 Bouffard et al.
7,462,114 B2 12/2008 Moller, Jr.
D584,368 S 1/2009 Stoewhass
D585,949 S 2/2009 Gaudin et al.
7,543,821 B2 6/2009 Winningham et al.
7,600,759 B2 10/2009 Crawley et al.
7,651,098 B2 1/2010 Cho
D623,246 S 9/2010 Nozato
7,828,296 B2 11/2010 Crawley et al.
7,909,330 B2 3/2011 Domjen
7,914,400 B2 * 3/2011 Flading ..... A63B 71/022 473/422
7,914,402 B2 3/2011 Gaudin et al.
8,043,172 B2 10/2011 Campanaro et al.
D649,209 S 11/2011 Silvi
8,177,651 B2 5/2012 Curry
8,246,496 B2 8/2012 Holland et al.
D689,570 S 9/2013 Adema
8,579,737 B2 11/2013 Holland et al.
8,590,901 B2 * 11/2013 Goldwitz ..... A63B 69/0097 273/395
8,647,221 B1 2/2014 Hochberg
8,651,979 B2 2/2014 Chen
8,651,980 B2 2/2014 Jackson
D703,774 S 4/2014 Riccardella et al.
8,758,173 B2 6/2014 Goodman
D709,970 S 7/2014 Holland
8,932,157 B2 1/2015 Wright
D731,013 S 6/2015 Jackowiak
9,162,127 B2 10/2015 Holland et al.
9,227,123 B2 1/2016 Debolt et al.
9,227,126 B2 1/2016 Christgau et al.
9,289,637 B2 3/2016 Publicover et al.
9,339,711 B2 5/2016 Goodman
9,452,337 B2 9/2016 Littman et al.
9,533,208 B2 1/2017 Wright
D779,602 S 2/2017 Hochberg
9,573,033 B2 2/2017 Surbrook
9,586,117 B2 3/2017 Freund
D789,466 S 6/2017 Cho et al.
D805,591 S 12/2017 Miller et al.
D806,812 S 1/2018 Adams
D809,076 S 1/2018 Yu et al.
9,908,023 B1 * 3/2018 Hamm ..... A63B 69/0097
9,987,536 B2 6/2018 Nash
9,999,816 B2 6/2018 Holland et al.
D833,547 S 11/2018 Weber
10,130,859 B1 11/2018 Riley
10,166,453 B1 1/2019 Dickerson
2002/0013187 A1 1/2002 Grunfeld
2002/0183127 A1 12/2002 Cho
2003/0060309 A1 3/2003 Smith
2004/0176193 A1 9/2004 Valliquette
2004/0235589 A1 11/2004 Wedgbury
2005/0049089 A1 3/2005 Pakieser
2005/0189719 A1 9/2005 Goldwitz
2005/0192125 A1 9/2005 Valliquette
2005/0275168 A1 12/2005 Kegevic et al.
2007/0090601 A1 4/2007 Liao
2007/0235942 A1 10/2007 Cho
2007/0281807 A1 12/2007 Cho
2008/0067751 A1 3/2008 Hunt
2011/0059815 A1 3/2011 Jones
2011/0092321 A1 4/2011 Szaro et al.
2014/0235374 A1 8/2014 Armell
2014/0296002 A1 10/2014 Luo
2016/0016060 A1 1/2016 Goldwitz
2016/0089587 A1 3/2016 Cowan
2016/0199718 A1 7/2016 Holland et al.
2016/0310774 A1 10/2016 Publicover et al.
2016/0339319 A1 11/2016 Weber
2017/0144046 A1 5/2017 Weber
2017/0157485 A1 6/2017 Esser
2017/0173435 A1 6/2017 Freund
2017/0189773 A1 7/2017 Cho
2017/0203176 A1 7/2017 Moros
2017/0259148 A1 9/2017 Mazloompour
2018/0099192 A1 * 4/2018 Crosby ..... A63B 61/04

FOREIGN PATENT DOCUMENTS

CN 106239440 A 12/2016
CN 106310620 A 1/2017
CN 206007967 U 3/2017
CN 206214704 U 6/2017
CN 106974438 A 7/2017
CN 206483083 U 9/2017
CN 107519631 A 12/2017
CN 107579602 A 1/2018
EP 0014133 8/1980
GB 1069207 5/1967
JP 2012020079 A 2/2012
WO 2006025752 3/2006
WO 2017123979 7/2017
WO 2018085919 5/2018

OTHER PUBLICATIONS

"M-Station by Munisports", Sep. 9, 2019, 1 page.
"Soccer Trainer by Tekk", Sep. 9, 2019, 1 page.
"Soccer Wave", Sep. 9, 2019, 1 page.
U.S. Appl. No. 16/700,136, Notice ofAllowance dated Jun. 25, 2021, 8 pages.
U.S. Appl. No. 16/700,136 , Non-Final Office Action, dated Nov. 27, 2020, 13 pages.
Application No. PCT/US2020/048381 , International Search Report and Written Opinion, dated Nov. 27, 2020, 11 pages.

(56) References Cited

OTHER PUBLICATIONS

International Application No. PCT/US2020/062754, International Search Report and Written Opinion dated Mar. 22, 2021, 15 pages.
Application No. PCT/US2020/062754, International Preliminary Report on Patentability, dated Jun. 16, 2022, 9 pages.
Application No. PCT/US2020/048381, International Preliminary Report on Patentability, dated Mar. 10, 2022, 8 pages.
CN 202080060881.X, "Office Action," dated Feb. 17, 2023, 17 pages.

* cited by examiner

REBOUNDING DEVICE FOR SPORTS BALL

CROSS-REFERENCE TO RELATED APPLICATION

This is a non-provisional application of, and claims priority to, U.S. Provisional Patent Application Ser. No. 62/892,797, filed Aug. 28, 2019, which is hereby incorporated by reference in its entirety for all purposes.

TECHNICAL FIELD

The disclosure herein generally relates to a rebounding device for sports balls, and more particularly, to a rebounding net device for the return of a ball to a player.

BACKGROUND

In many ball-related sports, such as soccer, baseball, lacrosse, and field hockey, players frequently pass balls to other players in attempts to make goals. Typically, players practice this skill in groups, by passing a ball back and forth amongst the players in the groups. Ball rebounding devices are useful, however, to allow a player to practice this skill as an individual without the necessity of a group setting.

Most ball rebounding devices use bungee cords, spring elements, or nonelastic straps to hold a net or other fabric within a frame, such as in U.S. Pat. Nos. 2,992,002, 4,489,941, 5,833,234, 6,299,544 and 5,615,889, for example. However, these rebounding devices are known to lose their rebounding capacity over time as the cords, spring elements and straps experience multiple cycles in response to balls being thrown against the nets.

Accordingly, a need exists for an improved rebounding device for sports balls in which the rebounding capacity is not diminished with time and normal use.

SUMMARY

One aspect of the disclosure relates to a rebounding device for sports balls including a frame defining a frame opening, a net disposed within the frame opening, a cable extending around a perimeter of the net and a cable tensioning system configured to tension the cable around the perimeter of the net and thereby pull the net taut within the frame opening.

Another aspect of the disclosure describes a rebounding device for sports balls including a frame defining a frame opening, a base member having at least two legs extending rearward from the frame opening, and a net disposed within the frame opening, wherein each of the at least two legs includes a pivotal foot configured to adjust an angle of the net relative to a ground engaging surface.

A still further aspect of the disclosure describes a rebounding device for sports balls including a frame defining a frame opening, a net disposed within the frame opening, and a cable extending around a perimeter of the net and configured to pull the net taut within the frame opening.

BRIEF DESCRIPTION OF THE DRAWING FIGURES

These and other features and advantages of the claimed invention will become more readily apparent to those skilled in the art upon reading the following detailed description, in conjunction with the appended drawings in which:

DETAILED DESCRIPTION

Figure 1:
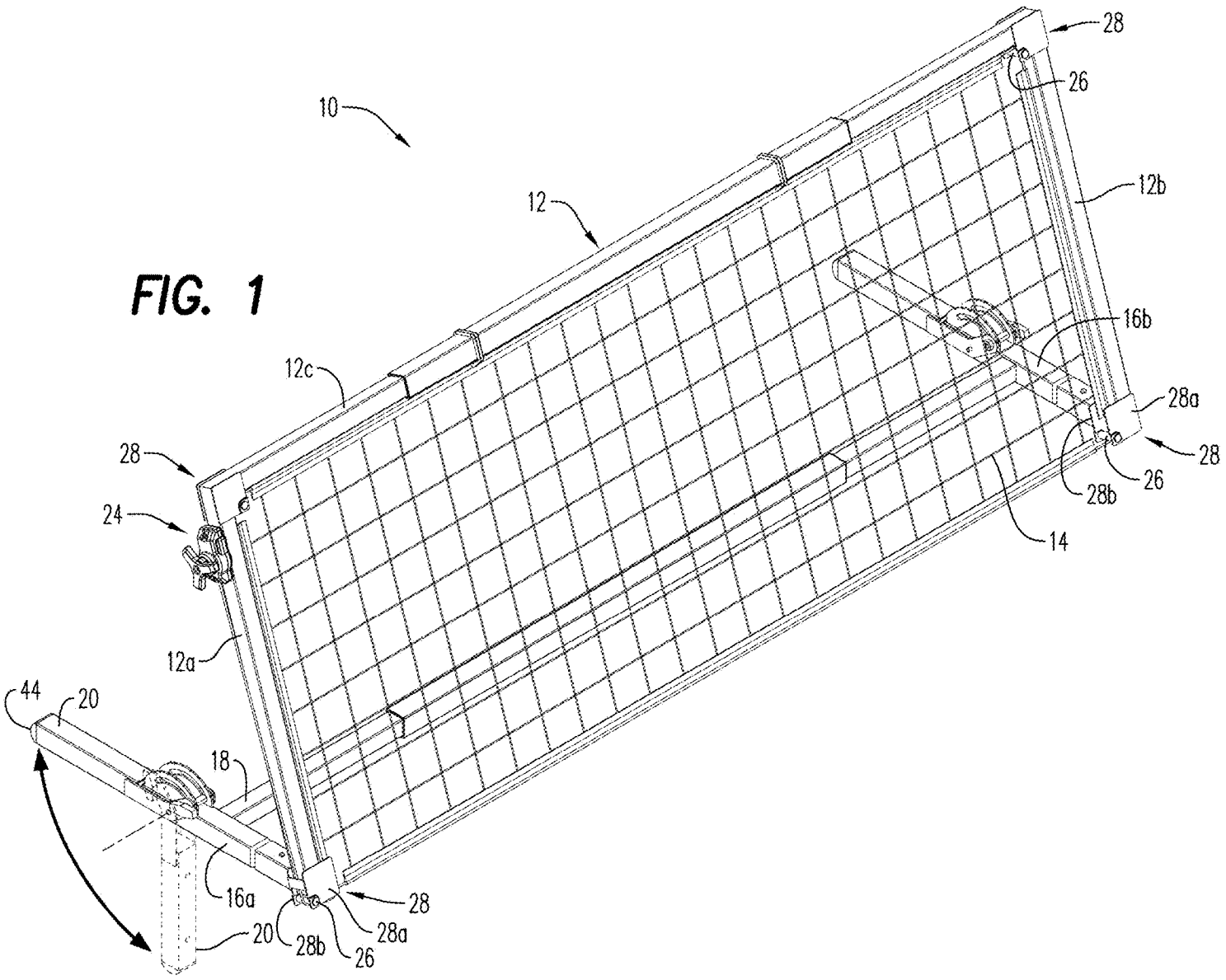
FIG. 1 is a front perspective view of a rebounding device according to one embodiment of the disclosure, the rotational positioning of the legs being shown in broken lines.
Figure 2:
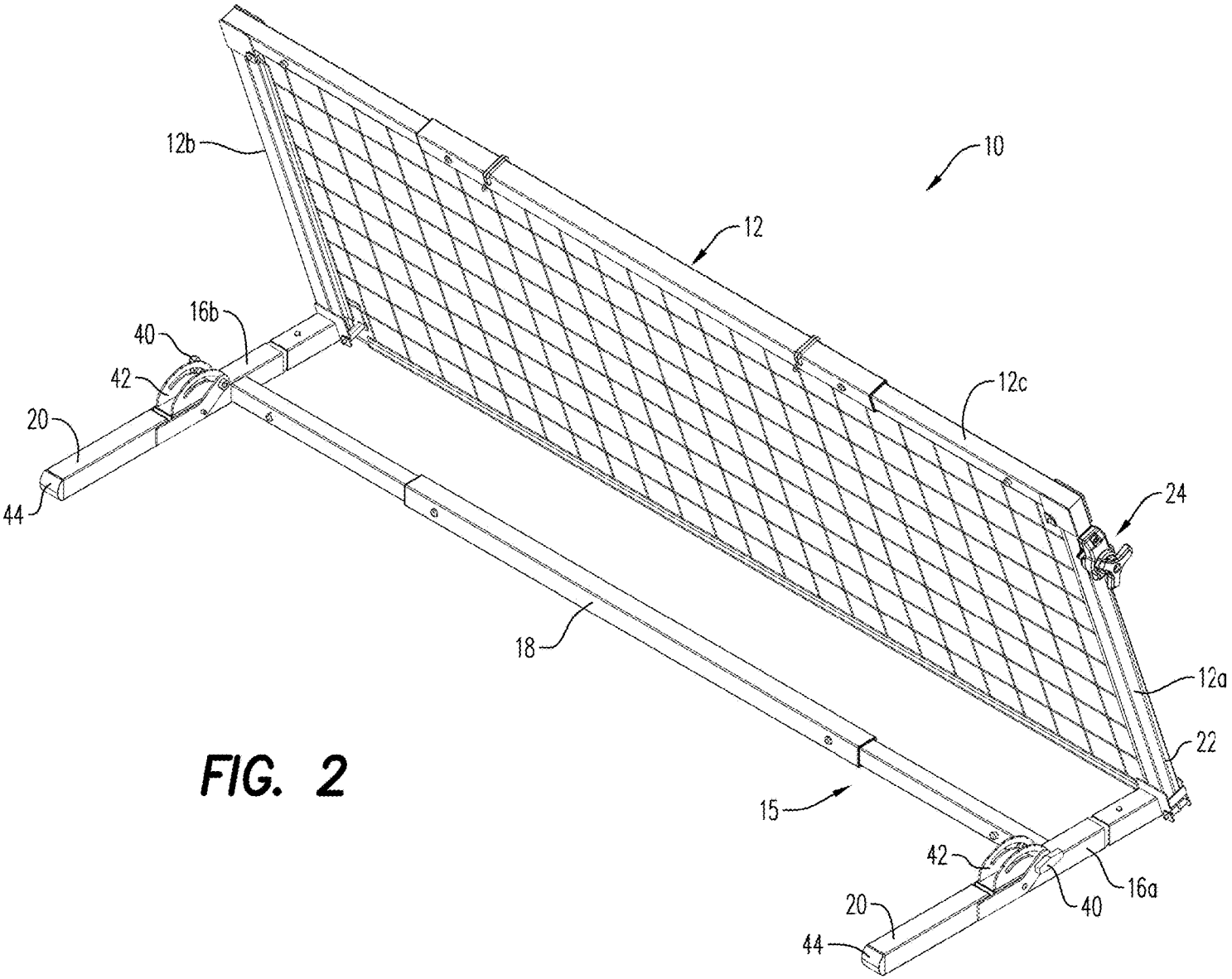
FIG. 2 is a rear perspective view of the rebounding device of FIG. 1.
Figure 3:
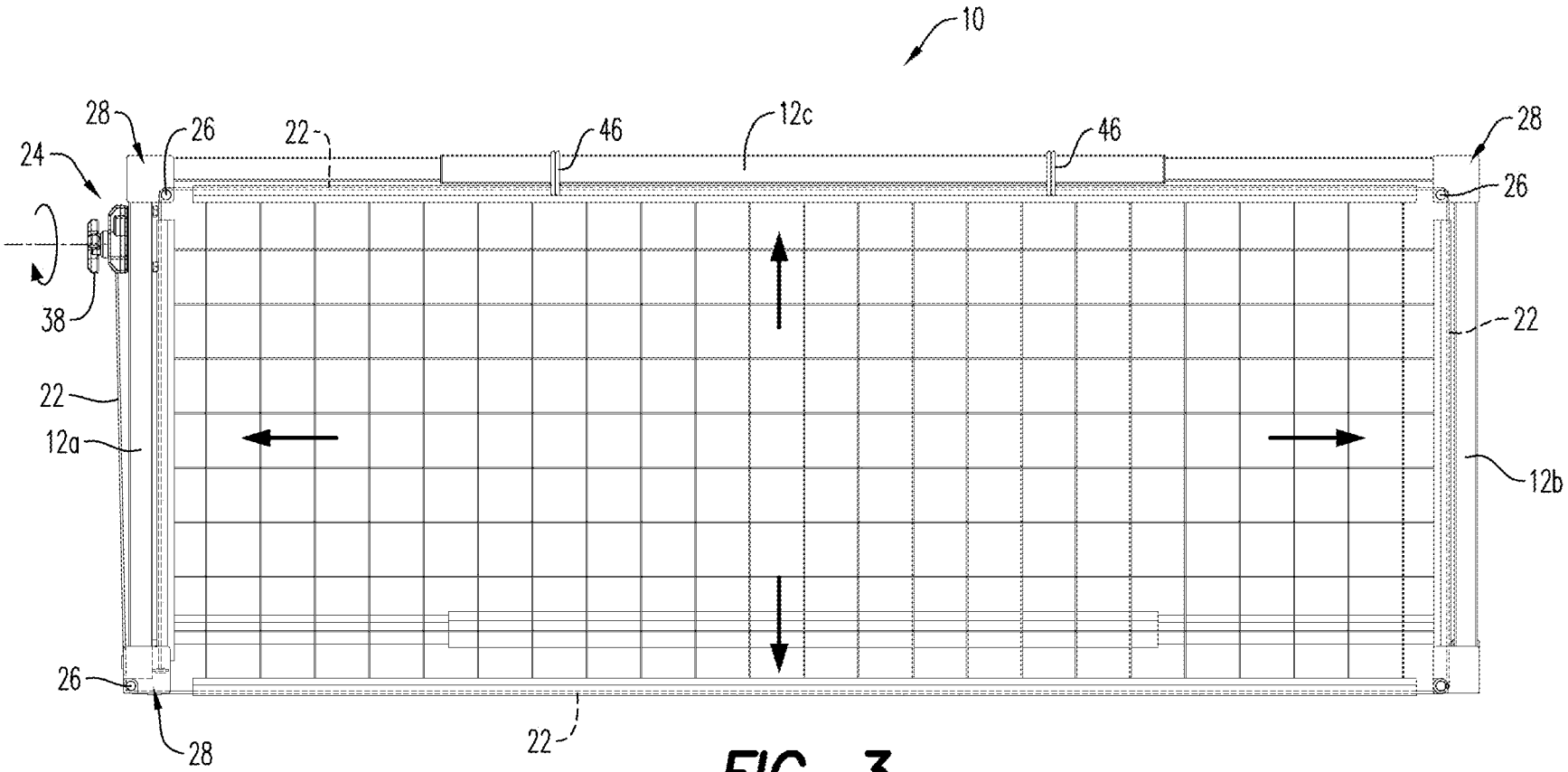
FIG. 3 is a front elevation view of the rebounding device of FIG. 1.

Referring to FIGS. 1-4, a rebounding device 10 according to an exemplary embodiment of the disclosure is shown. The rebounding device 10 includes a frame 12 with a net 14 extending within the opening of the frame 12. The net 14 is preferably formed from an inelastic mesh netting (e.g. including a polyester, polyethylene, and/or nylon material). In some aspects, other types of materials could be used, such as a netting comprising an elastic material. In still yet other aspects, the net 14 may be a solid piece of a fabric material, for example a woven fabric material, or other suitable material for rebounding of a ball for example. The frame 12 includes opposing side frame members 12*a*, 12*b* and an upper frame member 12*c* which together define a generally rectilinear structure, such as a rectangle or square. It should be noted, however, that other frame shapes (such as curved) may be suitable in some embodiments. The shape and geometry of the frame 12 may be dictated by the sport for which it is intended to train. In some embodiments, the frame 12 has only three frame members 12*a*, 12*b*, 12*c* in that there is no bottom frame member, and it is thus a bottomless frame. Such a bottomless configuration may be particularly suitable for soccer training as omission of a bottom frame member allows a soccer ball to be kicked into the net 14 without hitting the metal tubing of the frame structure. However, a four-sided frame may be suitable with other sports, such as baseball, lacrosse, and field hockey.

The lower ends of the side frame members 12*a*, 12*b* form ground engaging points of contact for the rebounding device 10. Extending rearward from the frame 12 is a base member 15 which provides support for the net 14. According to an exemplary embodiment, the base member 15 includes at least two rearward extending legs 16*a*, 16*b* and a support cross member 18 disposed between the legs 16*a*, 16*b*. Each of the legs 16*a*, 16*b* includes a pivotal foot 20, as discussed further below.

Figure 4:
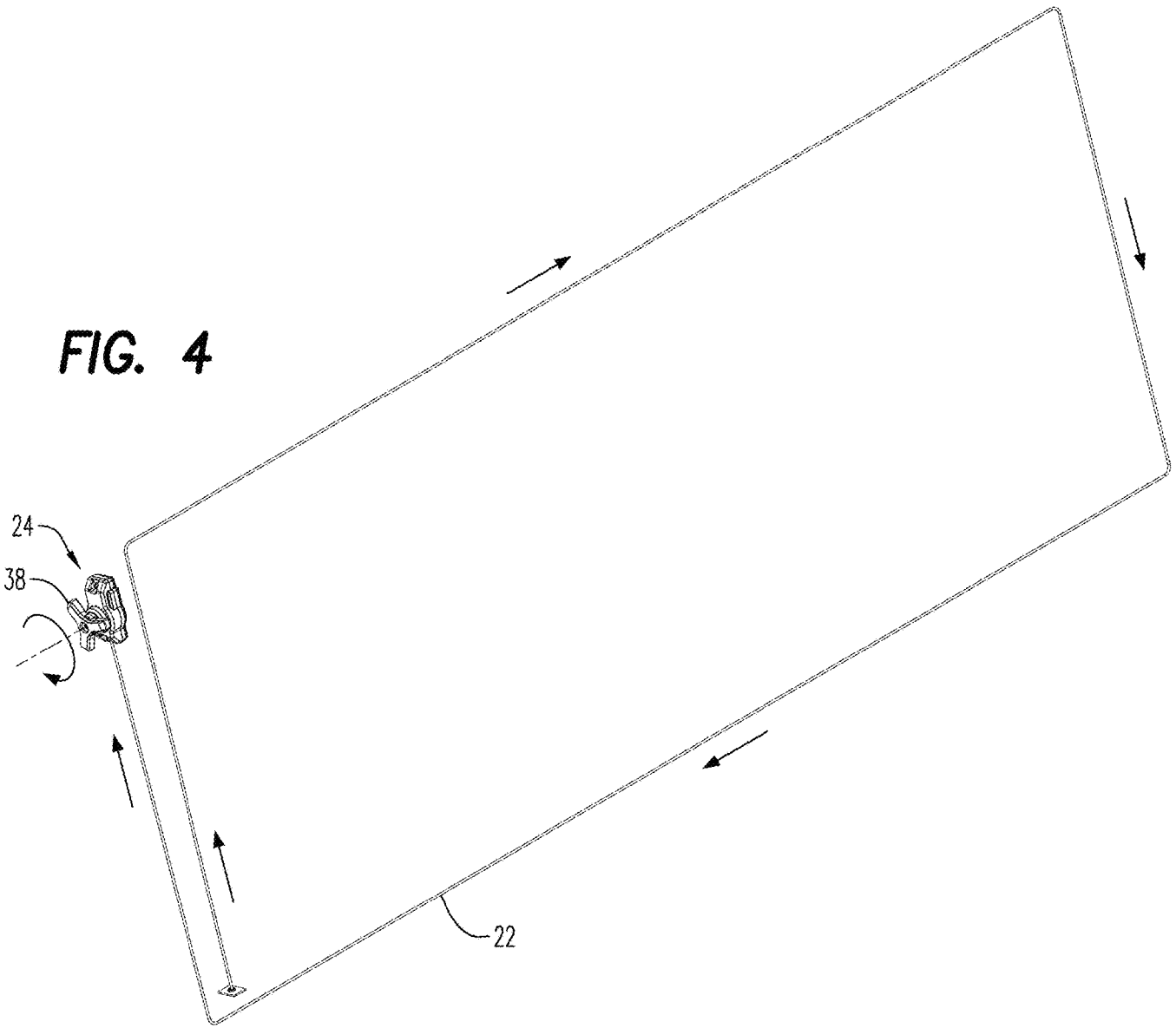
FIG. 4 is a schematic diagram of the tensioning cable utilized in the rebounding device of FIG. 1.
Figure 5:
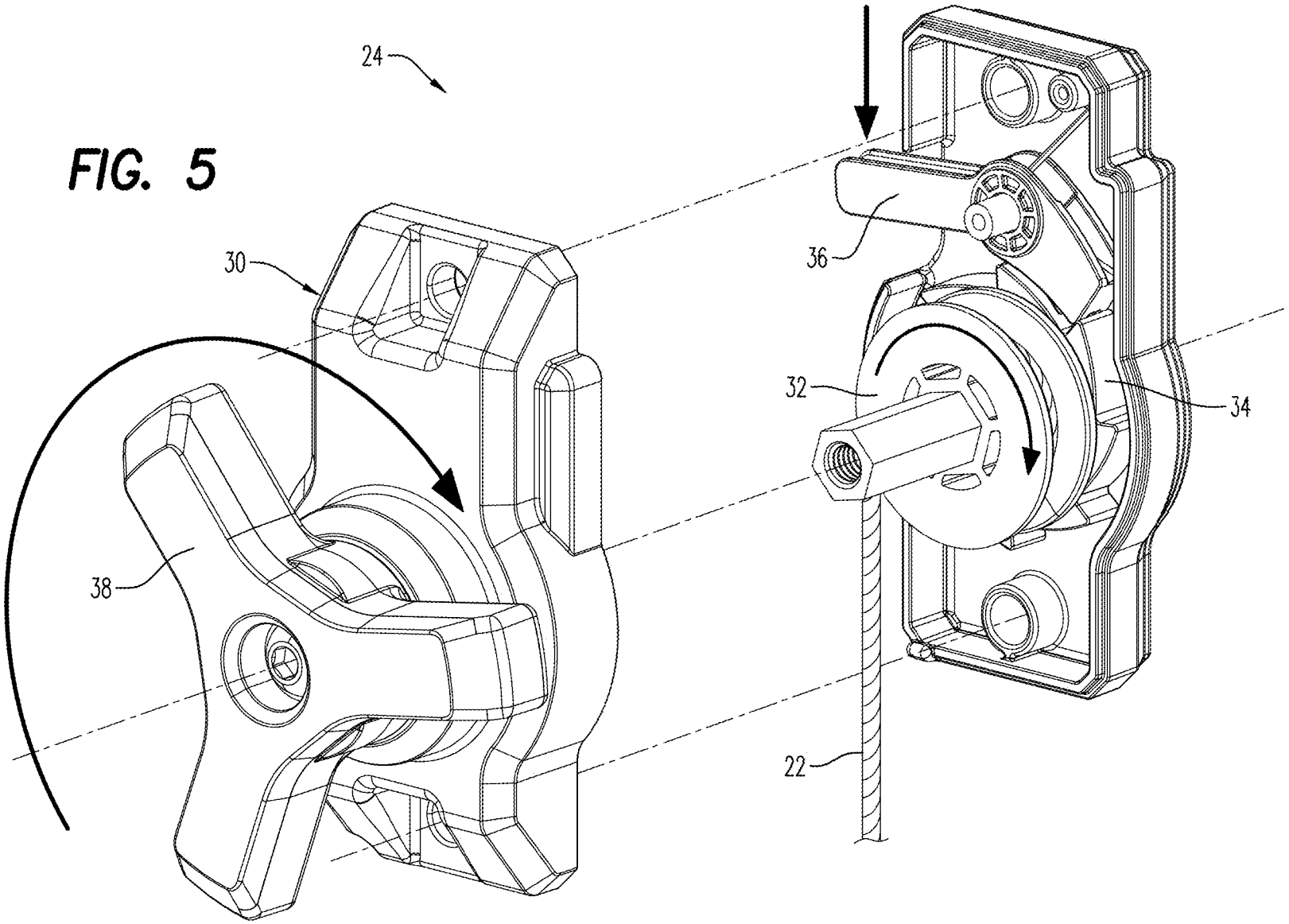
FIG. 5 is a schematic diagram of an embodiment of a tensioning mechanism utilized in the rebounding device according to exemplary embodiments of the disclosure.

A cable 22 is disposed around the perimeter of the net 14 and a cable tensioning mechanism 24 is utilized to maintain the net 14 taut within the frame 12. The cable 22 may be a non-elastic material, including a polyester, polyethylene, Kevlar, a metallic and/or a nylon material. In some aspects, however, the cable 22 may be an elastic material or a combination of elastic and non-elastic materials. More particularly, in one embodiment, the frame 12 includes four corner elements 28, each having a front member 28*a* and a rear member 28*b*. A corner spindle 26 is disposed between the front members 28*a* and the rear members 28*b*. The cable 22 thus extends around the perimeter of the net 14, by either being woven through the mesh of the net 14 or passed through a reinforcing hem of the net 14, and extends around each of the four corner spindles 26. With reference also to FIG. 4, the cable 22 is anchored or otherwise secured at one of the corner elements 28 of the frame 12, and then extends around the perimeter of the net 14 and around the four corner spindles 26. The other end of the cable 22 terminates at a cable tensioning mechanism 24 preferably disposed on a side of the frame 12. As illustrated in FIG. 5, an exemplary embodiment of the cable tensioning mechanism 24 includes a tensioning mechanism 30 having a drum 32, a gear 34, a spring-loaded arm 36, and a handle 38 rotatable connected to the drum 32. In order to tighten the cable 22 and thus tension the net 14 within the frame 12, a user rotates the handle 38 in a clockwise direction which thereby also turns the drum 32. As the drum 32 rotates, it winds the cable 22 up on the drum 32 and thereby tightens the net 14. The gear 34 and the spring-loaded arm 36 lock the drum 32 in place automatically when rotation is stopped. In order to release the tension in the net 14, such as when the rebounding device 10 is being folded for storage or transport, the handle 38 is first rotated clockwise sufficiently to remove the tension from the spring-loaded arm 36, generally only a few millimeters of rotation. A user then applies pressure in the downward direction on the spring-loaded arm 36 so as to release the locking of the gear 34. This in turn allows the handle 38 to spin counter-clockwise, thus releasing all of the tension in the cable tensioning mechanism 24. One or more clips 46, elastic bungee, or other retaining means may also be added to the middle of the net 14 in order to hold the netting up against the frame 12 and prevent the net 14 from sagging in the middle, if necessary, depending upon the overall size of the rebounding device 10.

Figure 7:
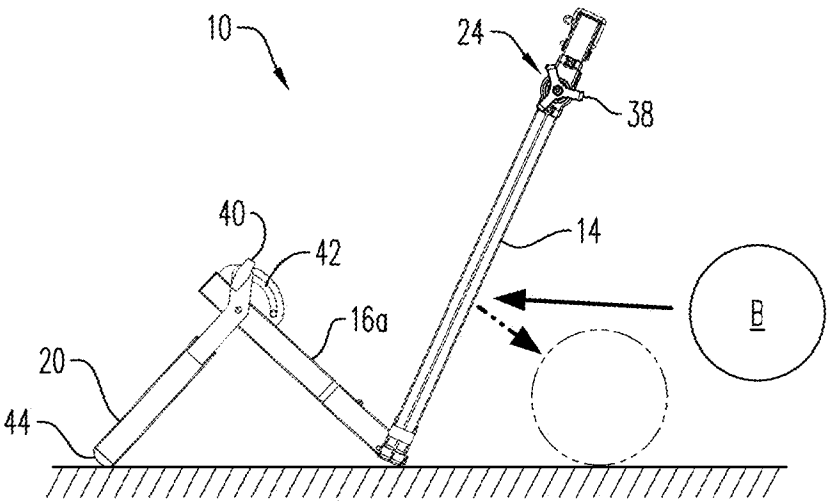
FIG. 7 is a side view of the rebounding device of FIG. 1, with the legs being shown in a second position.
Figure 6:
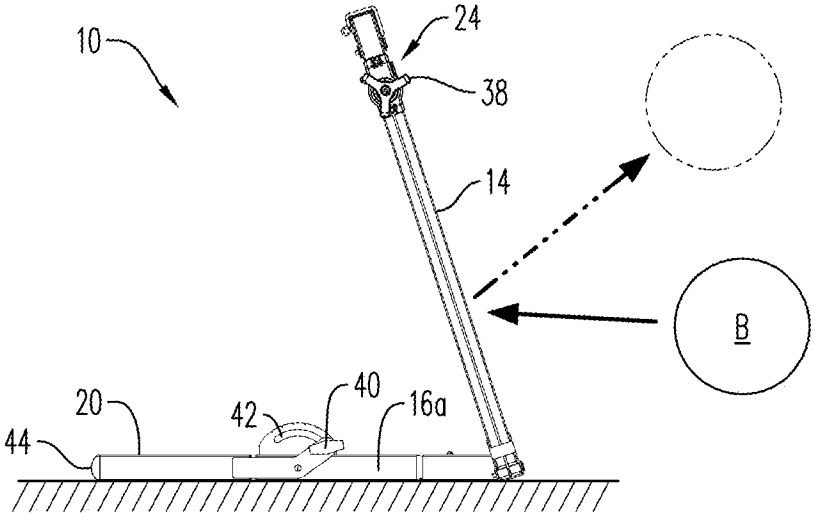
FIG. 6 is a side view of the rebounding device of FIG. 1, with the legs being shown in a first position.

The base member 15 includes foldable, rotatable risers or feet 20 which allow the angle of the net 14 to be adjusted. With reference to FIG. 1, the feet 20 are shown in a first position and a second rotated position is shown in broken lines. As shown best in FIG. 6, when the feet 20 are parallel with the legs 16*a*, 16*b*, i.e., flat on the ground surface, the net 14 forms an obtuse angle with the ground surface from the direction in which the ball B will be delivered. In such a case, the ball B is rebounded upwardly into the air, as shown in broken lines. Alternatively, as illustrated in FIG. 7, if the feet 20 are pivoted downward such that the feet 20 become the ground engaging member and the legs 16*a*, 16*b* are no longer resting on the ground, then the net 14 forms an acute angle with the ground surface from the direction in which the ball B will be delivered. In this instance, the ball B is rebounded back to the ground, as shown in broken lines. The feet 20 may be pivoted by moving a control handle 40 along an arcuate path on the pivot mechanism 42, or any other means which allows the feet 20 to be folded/unfolded or pivoted between a first predetermined position, a second predetermined position, or any angle there between. The base member 15 is preferably weighted by weights 44 so as to prevent the entire rebounding device 10 from tipping over when it is angled forward by the feet 20 as shown in FIG. 7. In some aspects, the feet 20 may not pivot relative to the legs 16*a*, 16*b*. In still yet other aspects, the feet 20 and/or the legs 16*a*, 16*b* may be oriented to raise a bottom edge of the net 14 and/or the frame 12 off the ground. In such aspects, the pivot mechanism 42 may be positioned in an alternative arrangement relative to the net 14, the feet 20, and/or the legs 16*a*, 16*b*, to permit orienting the net 14 at a desired angle when the net 14 and frame 12 are off the ground.

In a preferred embodiment, the rebounding device 10 may also be collapsible by pushing the side frame members 12*a*, 12*b* together, thereby causing upper frame member 12*c* and support cross member 18 to collapse in a telescoping manner. Upper frame member 12*c* and support cross member 18 may be fixedly locked in an extended position by pins, dents, clips or other means, which when released allow them to telescopically collapse.

As indicated above, the rebounding devices described herein may be utilized for other sports, with the particular frame geometry being dictated by the needs of a particular sport. For example, for use as a lacrosse or baseball rebounding device, the rebounding device may include a four-sided frame. Referring to FIGS. 8-13A, a rebounding device 110 with a four-sided frame 112 is illustrated. A net 114 extends within the opening of the frame 112, with the net 114 being preferably formed from an inelastic mesh netting (e.g. including a polyester, polyethylene, and/or nylon material). In some aspects, other types of materials could be used, such as a netting comprising an elastic material. In still yet other aspects, the net 114 may be a solid piece of a fabric material, for example a woven fabric material, or other suitable material for rebounding of a ball, for example. The frame 112 includes opposing side frame members 112*a*, 112*b*, an upper frame member 112*c*, and a lower frame member 112*d*, which together define a generally rectilinear structure, such as a rectangle or square. It should be noted, however, that other frame shapes (such as curved frames) may be suitable in some embodiments. In some embodiments, the frame 112 has four frame members 112*a*, 112*b*, 112*c*, and 112*d* to form a closed rectangular frame 112. In some embodiments, the frame 112 may be formed as a single piece, while in other embodiments, the frame 112 may be formed from multiple pieces that are joined together, such as by nesting, spring-biased pin connections, using fasteners, and/or other coupling mechanisms.

Figure 9:
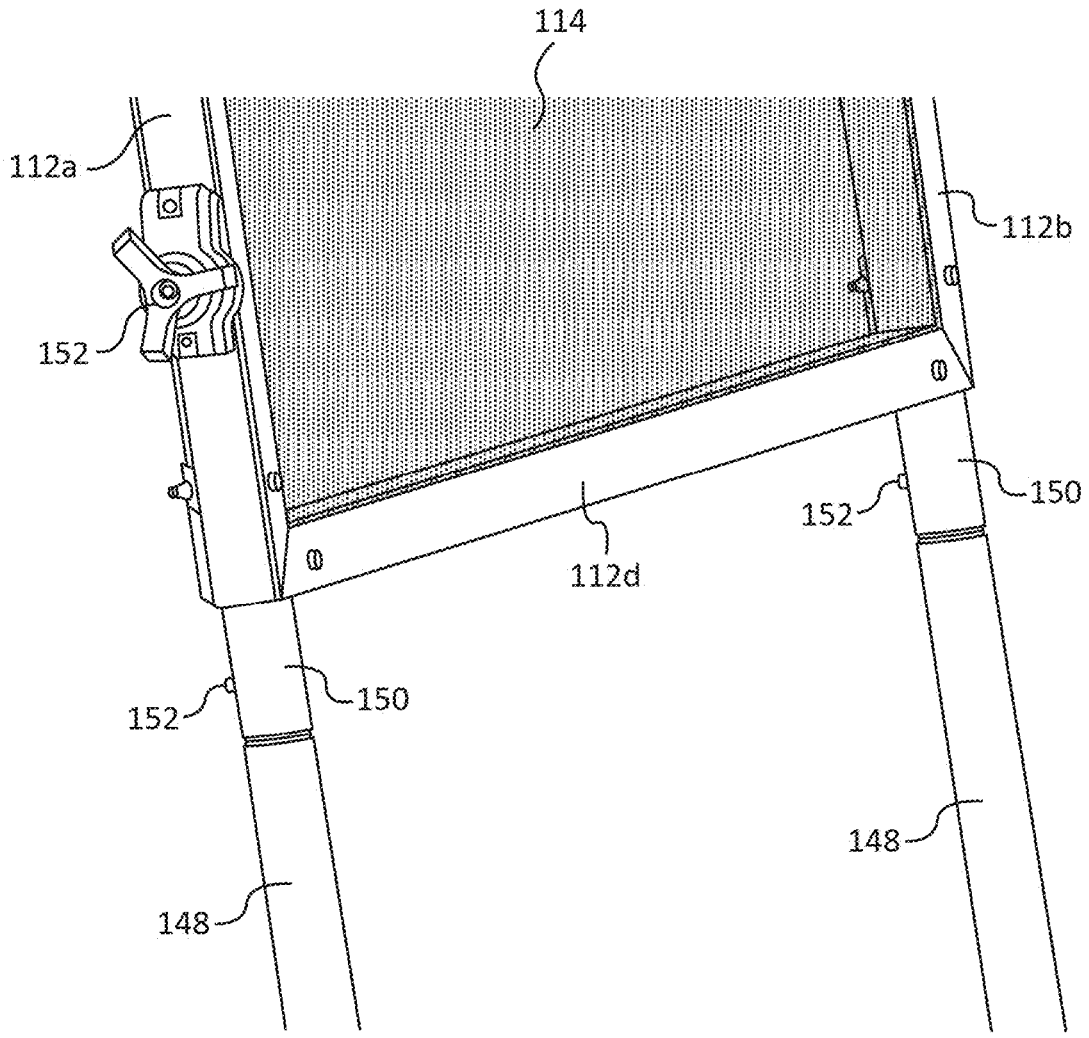
FIG. 9 is a partial front perspective view of a coupling between a frame and vertical support members of the rebounding device of FIG. 8.

The frame 112 may be coupled with a base member 115, which provides support for the frame 112 and net 114. In some embodiments, the frame 112 is coupled with the base member 115 via one or more vertical members 148 that extend from the frame 112 toward the base member 115 to elevate the frame 112 and net 114 off the ground. In some embodiments, the vertical members 148 may be formed integrally with and/or otherwise permanently coupled with the frame 112. In other embodiments, the vertical members 148 may be removably coupled with the frame 112. For example, as shown in FIG. 9, the frame 112 defines receptacles 150 that are configured to receive ends of the vertical members 148. In some embodiments, the vertical members 148 may be secured within the receptacles 150 using spring loaded pins 152. It will be appreciated that other coupling mechanisms may be used to secure the vertical members 148 with the frame 112.

Figure 10:
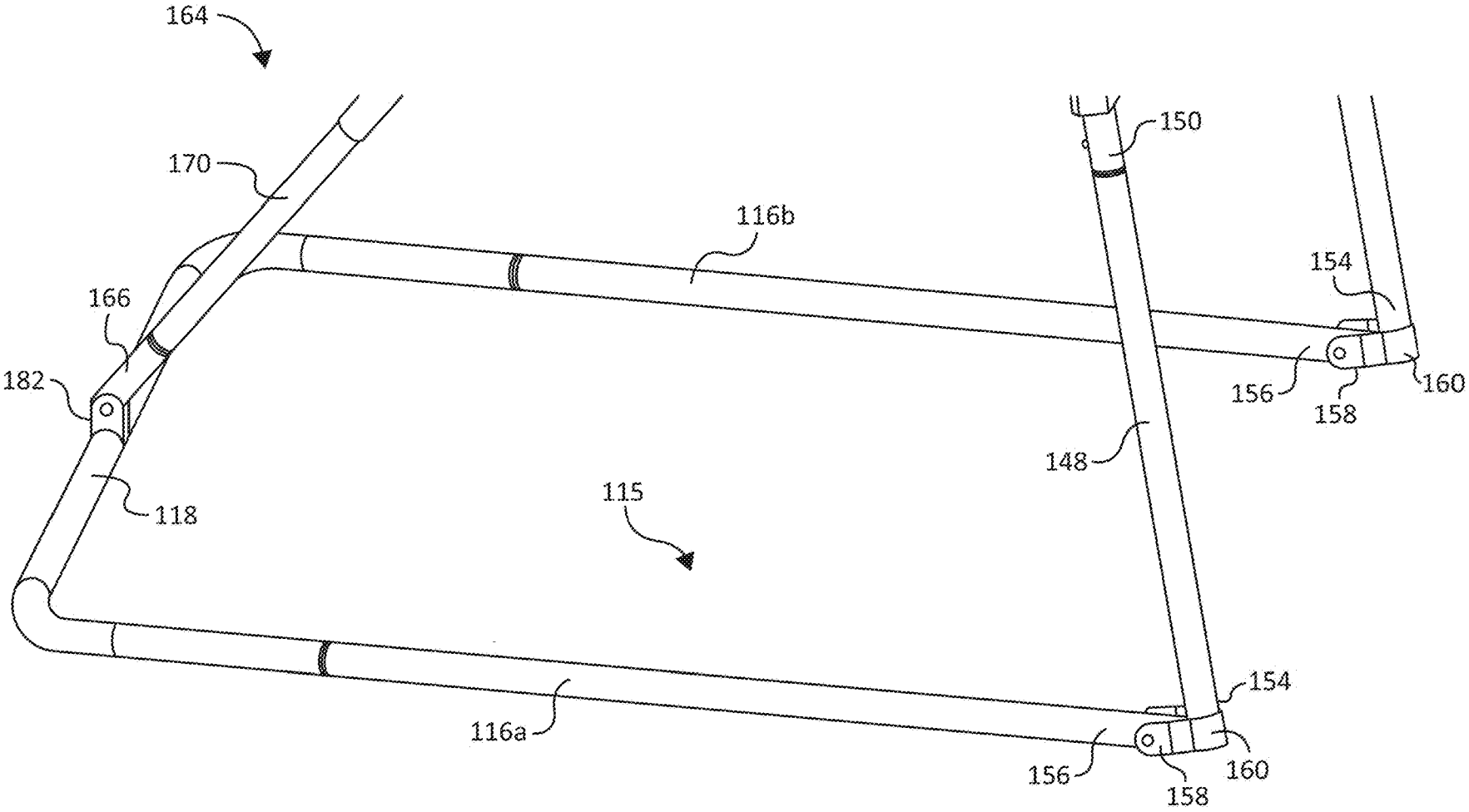
FIG. 10 is a partial perspective view of a base of the rebounding device of FIG. 8.
Figure 10A:
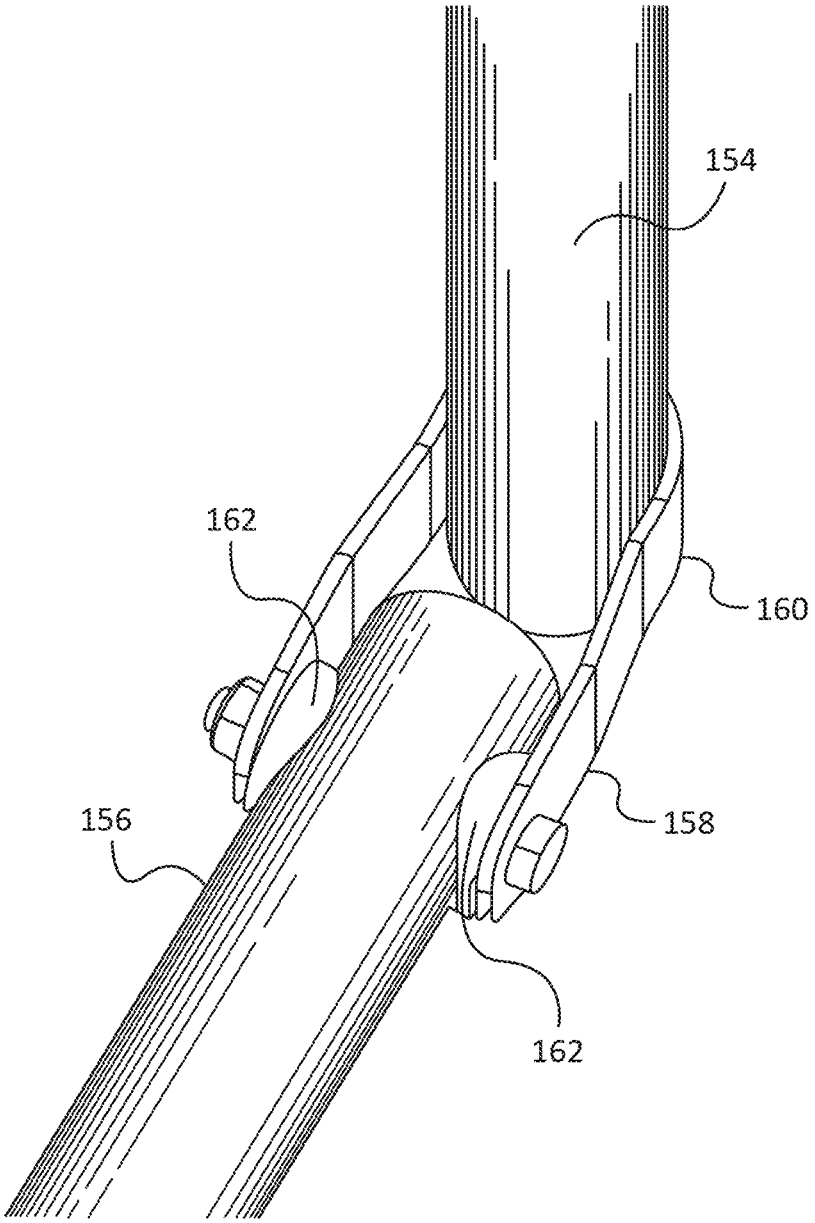
FIG. 10A illustrates a coupling of a vertical support member and the base of the rebounding device of FIG. 8.

The base member 115 may couple with bottom ends 154 of the vertical members 148 and may extend rearward from the frame 112. According to an exemplary embodiment, the base member 115 includes at least two rearward extending legs 116*a*, 116*b* and a support cross member 118 disposed between the legs 116*a*, 116*b*. While shown with the support cross member 118 positioned at a rear of legs 116*a*, 116*b*, it will be appreciated that the support cross member 118 may be disposed at a more medial position of the legs 116*a*, 116*b*, similar to the support cross member 18 of rebounding device 10. As illustrated in FIGS. 10 and 10A, front ends 156 of each leg 116*a*, 116*b* are coupled with the bottom ends 154 of the vertical members 148. In some embodiments, the front ends 156 may be pivotally coupled with the bottom ends 154, allowing an angle of the frame 112 and net 114 to be adjusted. For example, a bracket 160 may extend around the bottom ends 154 and include arms 158 positioned on either side of and attached to a respective front end 156. Bushings 162 may be positioned between the arms 158 and the front ends 156, allowing the bracket 160 and vertical members 148 to pivot relative to the legs 116*a*, 116*b*. In other embodiments different pivoting mechanisms and/or hinges may be used.

Figure 8:
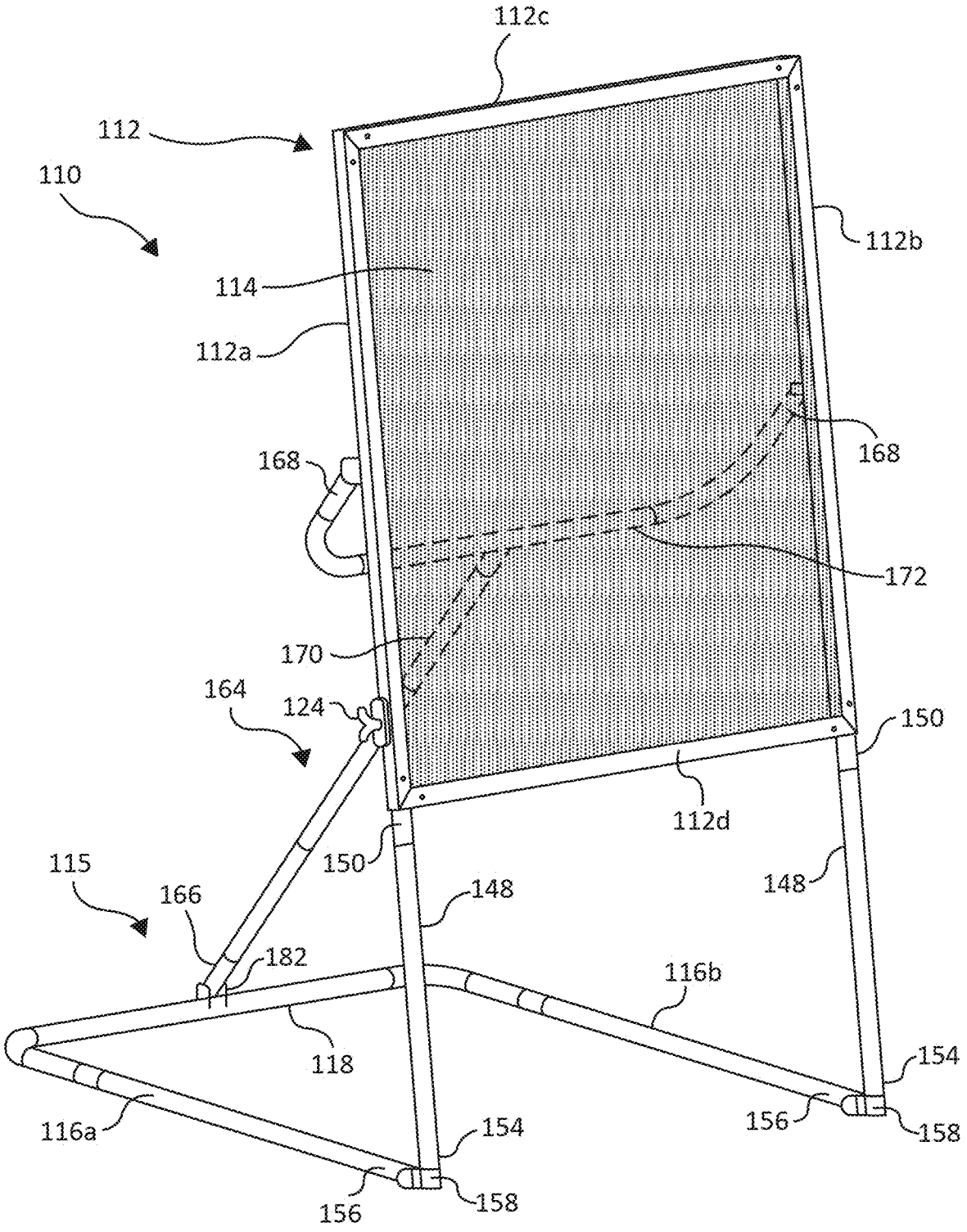
FIG. 8 is a front perspective view of a rebounding device according to another embodiment of the disclosure.
Figure 11:
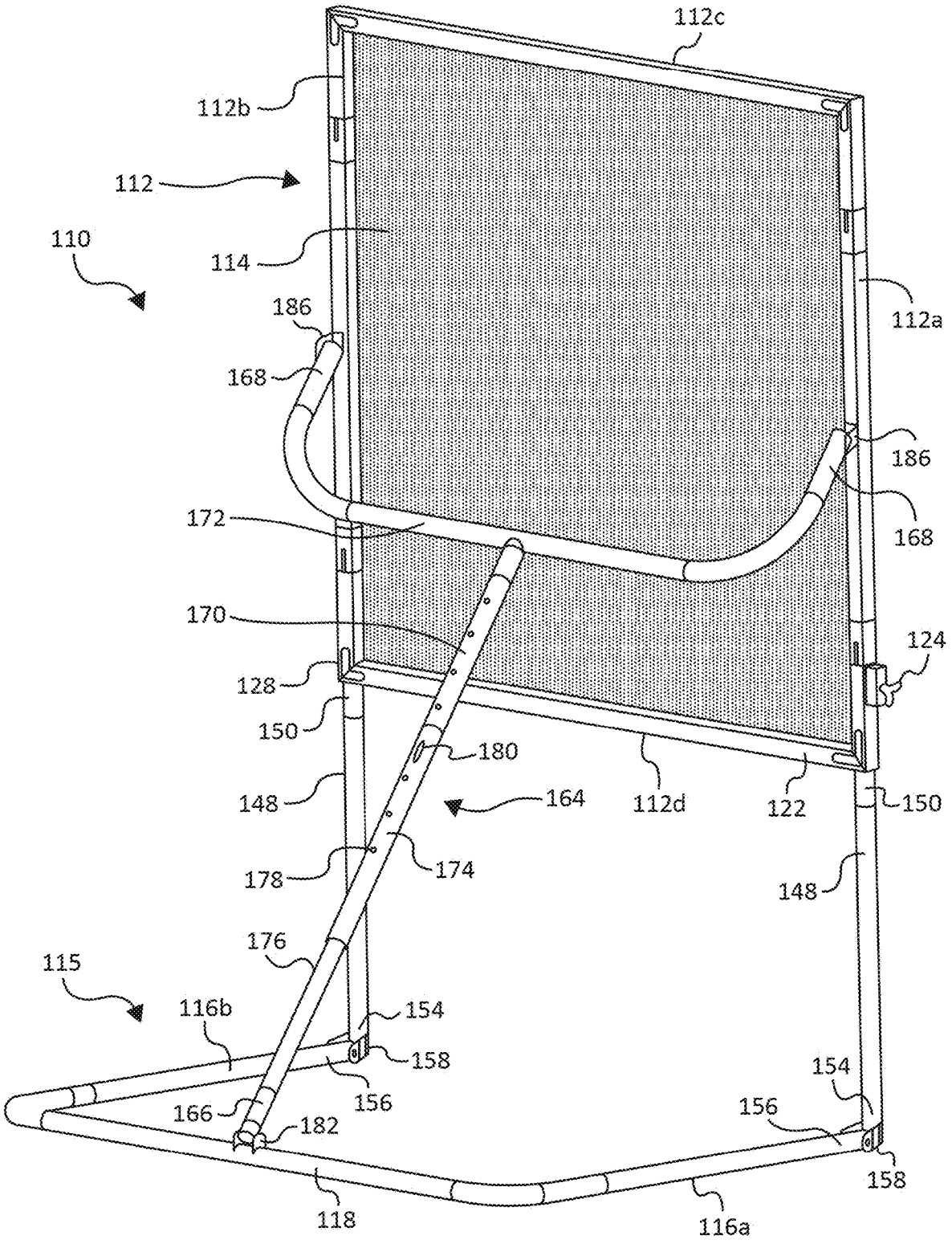
FIG. 11 is a rear perspective view of the rebounding device of FIG. 8.

In some embodiments, the rebounding device 110 may further include an angled member 164 that extends between the base member 115 and the frame 112 to maintain the frame 112 at a desired angle, as illustrated in FIGS. 8 and 11. For example, a lower end 166 of the angled member 164 may couple with the support cross member 118 and one or more upper ends 168 of the angled member 164 may couple with the side frame members 112*a*, 112*b*. Here, angled member 164 includes a central member 170 that couples with a medial portion of an upper cross member 172, which extends transversely relative to the central member 170 and couples with the side frame members 112*a*, 112*b*. Here, upper cross member 172 is generally Y-shaped so as to enable connection with the central member 170 and each of the side frame members 112*a*, 112*b*. It will be appreciated that other forms and/or numbers of angled members may be used in some embodiments. For example, angled members on either side of the rebounding device 110 may extend between a leg 116*a*, 116*b* and a corresponding side frame member 112*a*, 112*b*. In other embodiments, one or more angled members may extend between a medial portion of the support cross member 118 and one or both of the upper frame member 112*c* and the lower frame member 112*d*.

Figure 11A:
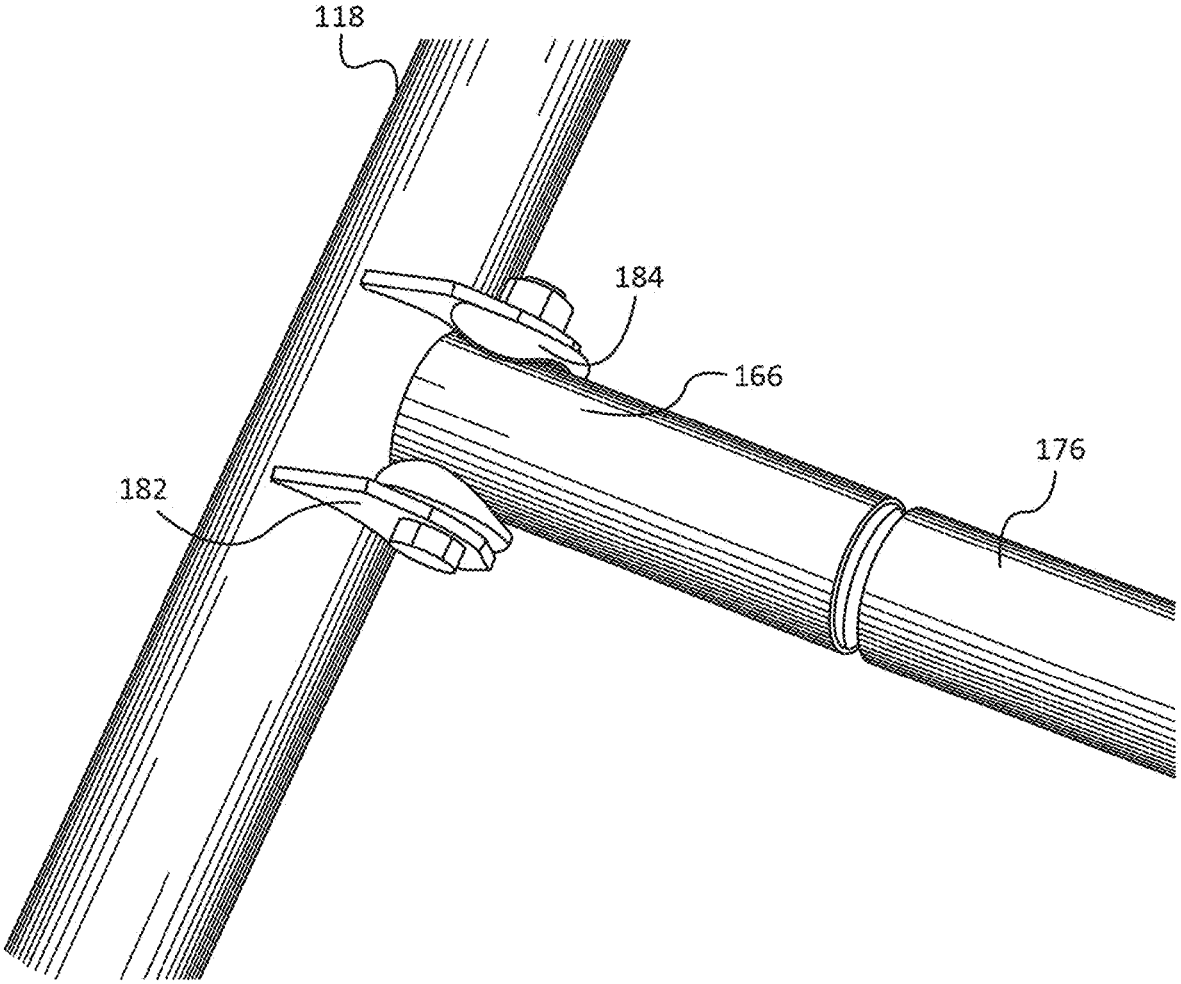
FIG. 11A illustrates a coupling of an angled support member and the base of the rebounding device of FIG. 8.
Figure 12:
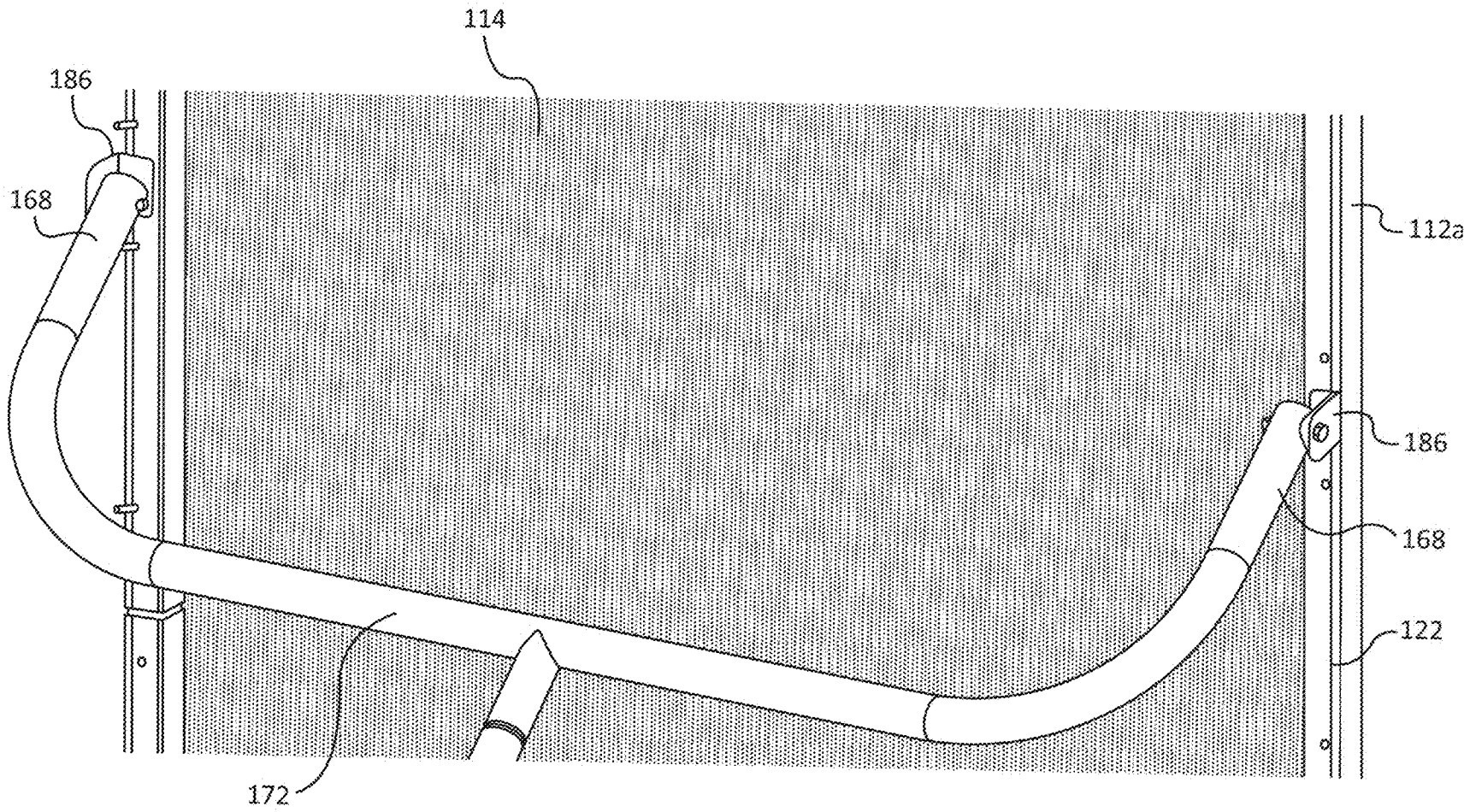
FIG. 12 illustrates a coupling of an angled support member and the frame of the rebounding device of FIG. 8.
Figure 12A:
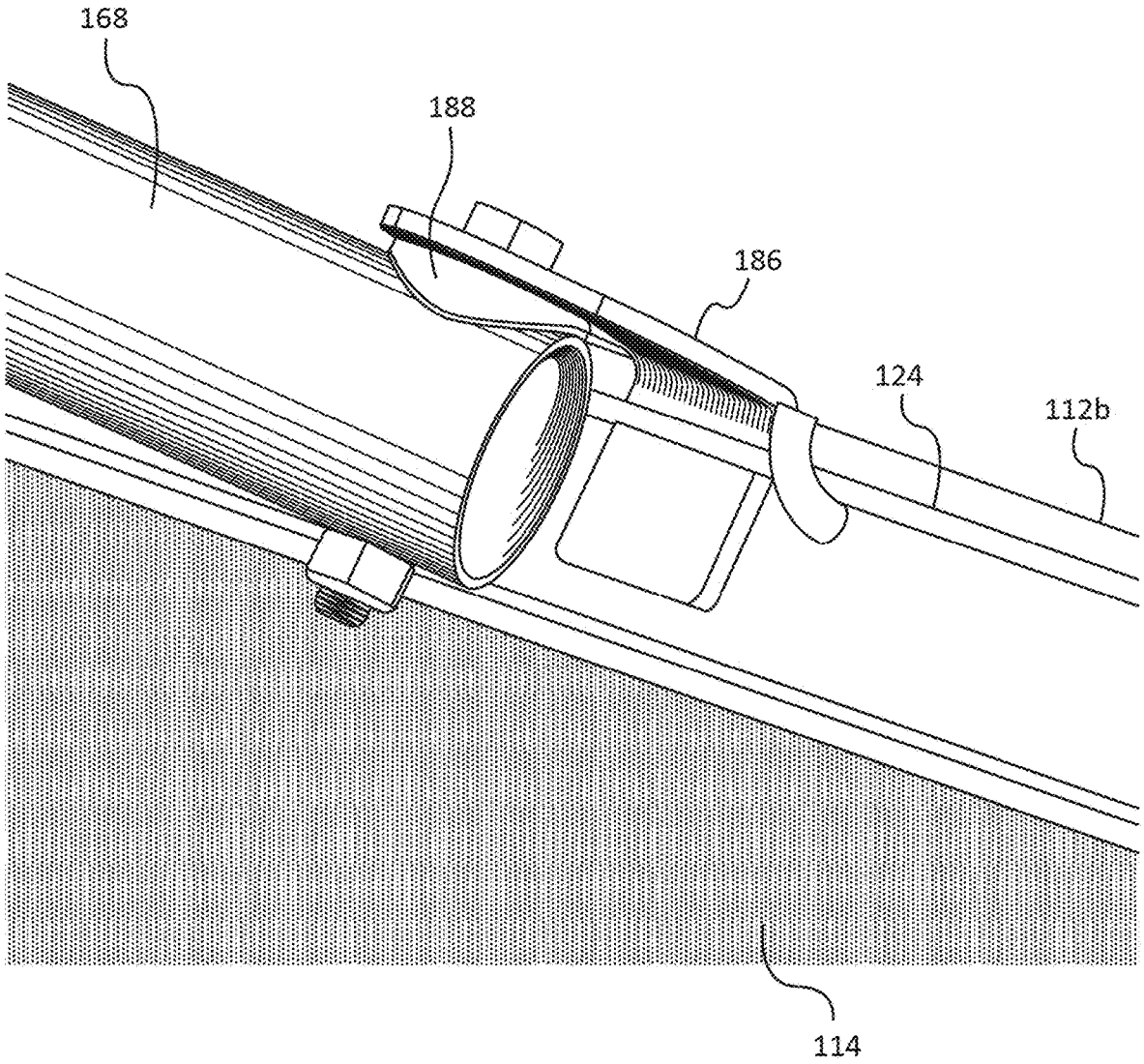
FIG. 12A illustrates a coupling of an angled support member and the frame of the rebounding device of FIG. 8.

In some embodiments, the angled member 164 may be configured to telescope to enable an angle of the frame 112/net 114 to be adjusted relative to the base member 115. For example, one or more components of the angled member 164 may be extendable to adjust a length of the angled member 164. As illustrated, central member 170 is formed of a first rod 174 that slidingly receives a second rod 176. The first rod 174 defines a number of apertures 178 along a length of the first rod 174, while the second rod 176 includes a spring-loaded pin 180 that is selectively positionable within the apertures 178 to set a length of the angled member 164. To facilitate angle adjustments, the angled member 164 may be pivotally coupled with the base member 115 and/or frame 112. For example, as shown in FIG. 11A, the lower end 166 of the angled member 164 may be coupled with a bracket 182 that extends from a medial portion of the support cross member 118, with one or more bushings 184 positioned between the bracket 182 and the lower end 166 to facilitate rotation at the joint. Similarly, as shown in FIGS. 12 and 12A, upper ends 168 may be coupled with fasteners to brackets 186 that extend from the side frame members 112*a*, 112*b*, with one or more bushings 188 positioned between the brackets 186 and the upper ends 168 to facilitate rotation at the joint. To adjust an angle of the net 114, the angled member 164 may be shortened or lengthened by sliding the first rod 174 relative to the second rod 176 while 1) pivoting the vertical members 148 relative to the legs 116*a*, 116*b* and 2) pivoting the angled member 164 relative to one or both of the support cross member 118 and the frame 112.

In some embodiments, the components of frame 112 and/or base member 115 may each be formed as a single piece. In other embodiments, the components may be formed from several pieces that are fixedly or removably joined. In some embodiments, one or more of these components may include additional features. For example, reinforcement members, and/or other features that provide strength, stability, and/or other characteristics to the rebounding device 110 may be included.

In some embodiments, the various pieces of the base member 115, vertical members 148, and/or angled member 164 may be connected to one another directly. For example, one or more of the base member 115, vertical members 148, and/or angled member 164 may include mating features that are used to secure the pieces of the rebounding device 110 together. In other embodiments, the pieces of the base member 115, vertical members 148, and/or angled member 164 may be secured using one or more fasteners (such as nuts and bolts) and/or may be permanently secured to one another, such as via welding. In other embodiments, the various pieces of the base member 115, vertical members 148, and/or angled member 164 may be connected via one or more joint members that may have mating features that are usable to assemble the frame 102. In some embodiments, the rebounding device 110 may be capable of being disassembled and packed into a smaller form factor for storage and/or transport.

Figure 13:
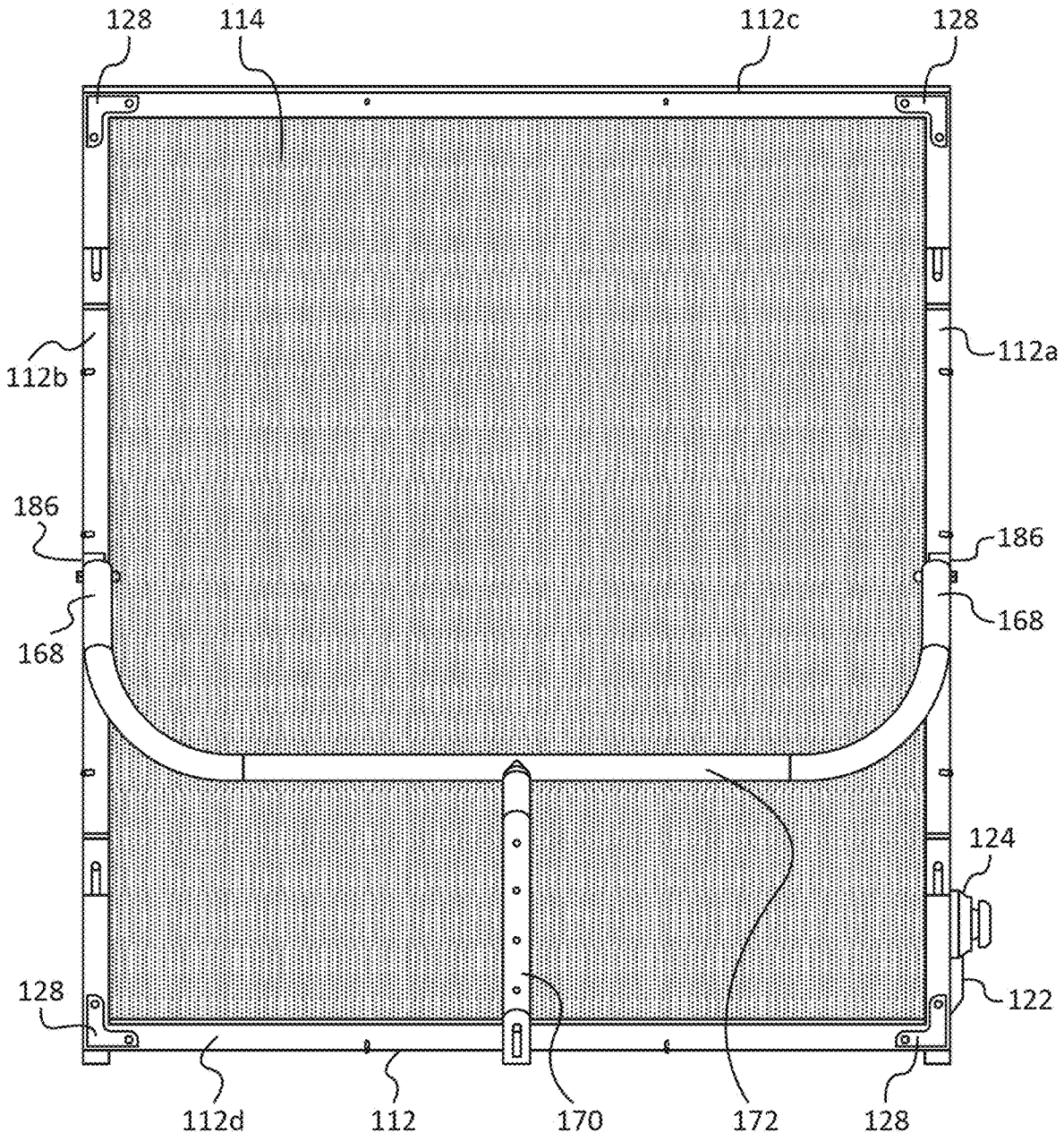
FIG. 13 is a partial rear view showing a cable tensioning system of the rebounding device of FIG. 8.
Figure 13A:
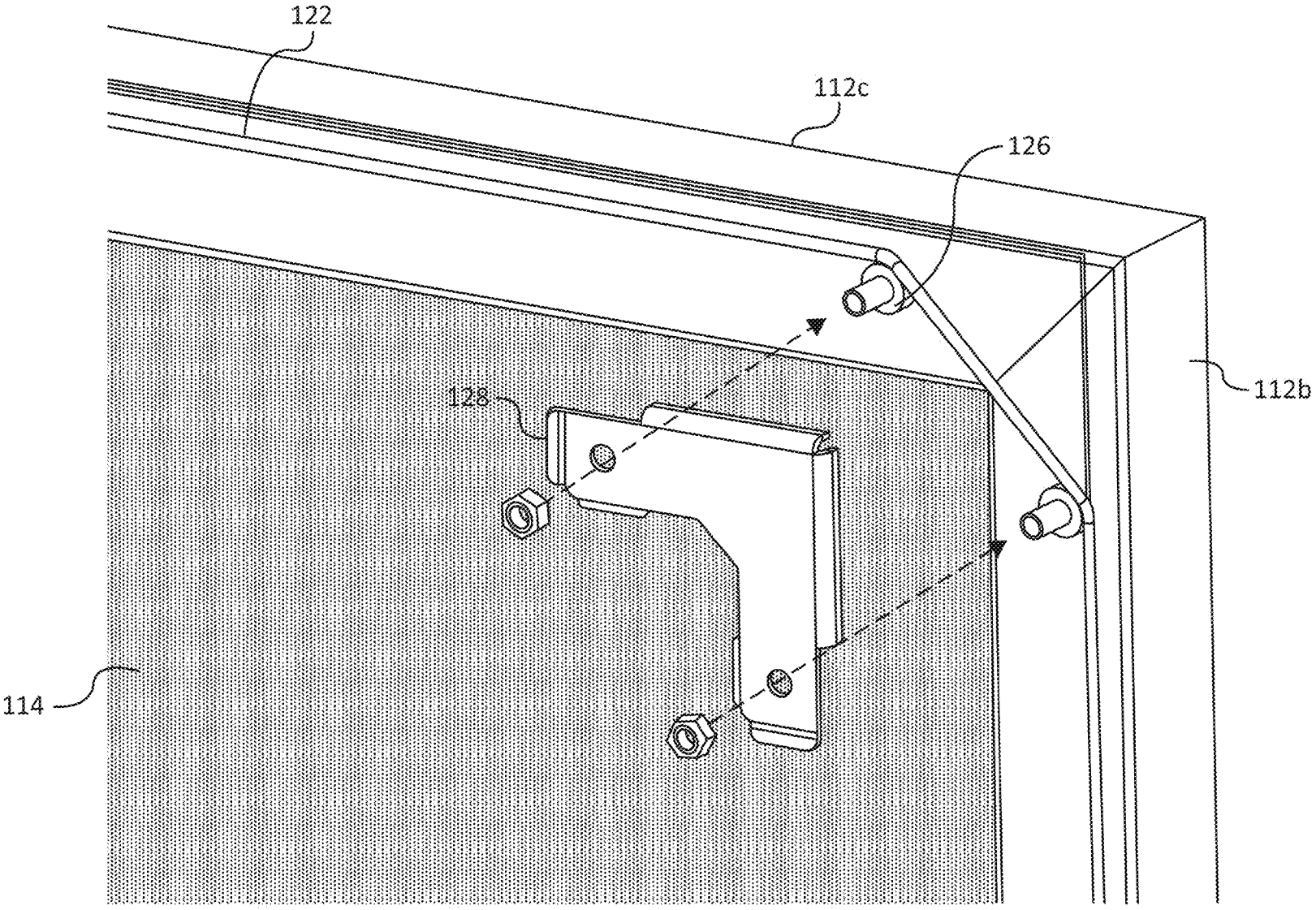
FIG. 13A illustrates a corner frame and spindle assembly of the cable tensioning system of the rebounding device of FIG. 13.

As shown in FIG. 13, cable 122 is disposed around the perimeter of the net 114 and a cable tensioning mechanism 124 (which may be similar to cable tensioning mechanism 24 described above) is utilized to maintain the net 114 taut within the frame 112. The cable 122 may be a non-elastic material, including a polyester, polyethylene, Kevlar, a metallic and/or a nylon material. In some aspects, however, the cable 122 may be an elastic material or a combination of elastic and non-elastic materials. More particularly and as best seen in FIG. 13A, in one embodiment the frame 112 includes one or more corner spindles 126 extending from the rear surface of the frame 112 proximate the corners of the frame 112. The cable 122 thus extends around the perimeter of the net 114, by either being woven through the mesh of the net 114 or passed through a reinforcing hem of the net 114, and extends around each of the corner spindles 126. In some embodiments, four corner spindles 126 may be used, with each corner spindle 126 centered about a respective corner of the frame 112 to produce a cable path that is generally rectangular as shown in relation to FIGS. 1-4 above. In other embodiments, such as shown in FIG. 13A, two or more corner spindles 126 are positioned at each corner element 128, with the corner spindles 126 being positioned slightly inward from a respective corner of the frame 112 so as to produce a cable path with angled corners. For example, the cable path may be octagonal, with long major sides following the shape of the frame 112 and with minor sides proximate the corners of the frame that are at an angle relative to the major sides. A corner element 128 is mounted and secured on the corner spindles 126 (such as via nuts 129) at each frame corner to ensure that the cable 122 cannot disengage from the corner spindles 126.

One end of the cable 122 may be anchored or otherwise secured to a corner spindle 126 at one of the corners of the frame 112, and then extends around the perimeter of the net 114 and around the corner spindles 126 in a manner similar to that shown in FIG. 4 above. The other end of the cable 122 terminates at a cable tensioning mechanism 124 preferably disposed on a side of the frame 112. Cable tensioning mechanism 124 may have a similar design and operation as the cable tensioning mechanism 24 described in relation to FIG. 5.

In some embodiments, the vertical members 148 may be shorter than illustrated in FIGS. 8-13A. This may be particularly useful for practicing certain sport-related activities, such as pitching a baseball or taking a low lacrosse shot that require a player to throw and/or otherwise direct a ball lower to the ground. In some embodiments, the vertical members 148 may be fixed at lower heights, while in other embodiments the vertical members 148 may be configured to telescope and/or otherwise adjust to positions that drop a height of the net 114 to a sufficiently low level to practice such sport maneuvers.

Although certain exemplary embodiments of the disclosure have been shown and described in detail, it should be understood that various changes and modifications may be made therein without departing from the scope of the appended claims.

What is claimed is:

1. A rebounding device for sports balls comprising:

a frame defining a frame opening;

a net disposed within said frame opening, the net comprising a top side, a bottom side opposite the top side, a left side, and a right side opposite the left side, wherein the top side, bottom side, left side, and right side of the net define a perimeter of the net;

a cable extending around the net along a cable path that extends along, and in a direction substantially parallel to, each of the top side, the bottom side, the left side, and the right side of the net, wherein the cable path is substantially rectangular; and a cable tensioning system mounted on the frame and configured to tension said cable around the perimeter of said net and thereby pull said net taut within the frame opening along the top side, the bottom side, the left side, and the right side of the net.

2. The rebounding device according to claim 1, wherein:

said cable tensioning system includes a tensioning mechanism having a rotatable handle for winding said cable onto a drum, and a gear and spring-loaded lever arm configured to lock said drum into a fixed position.

3. The rebounding device according to claim 1, wherein:

said frame comprises a plurality of corners and at least one spindle extending from each corner of said frame, said cable extending around each of said spindles.

4. The rebounding device according to claim 3, wherein:

a first end of said cable is secured to one of said spindles and a second end of said cable is secured to said cable tensioning system.

5. The rebounding device according to claim 1, further comprising a base member coupled to the frame and comprising a first leg, a second leg, and a support cross member extending between the first leg and the second leg.

6. The rebounding device according to claim 5, further comprising:

an angled member that extends upwardly between the support cross member and the frame.

7. The rebounding device according to claim 6, further comprising:

at least two vertical members extending between the frame and the first leg and the second leg of the base member, the at least two vertical members being pivotally coupled with at least one of the first leg and the second leg, wherein the angled member is configured to telescope to adjust an angle between the frame and the base member by pivoting the at least two vertical members relative to the first leg and the second leg.

8. The rebounding device according to claim 1, wherein:

said frame opening is defined by only opposing side frame members and an upper frame member.

9. The rebounding device according to claim 8, further comprising:

a base member coupled to the frame and comprising a first leg, a second leg, and a support cross member extending between the first leg and the second leg, wherein said upper frame member and said support cross member are telescopically collapsible when said opposing side frame members are moved inwardly towards one another.

10. The rebounding device according to claim 1, further comprising a base member coupled to the frame and comprising a first leg and a second leg that extend rearwardly relative to said frame opening, wherein:

the first leg comprises a first foot that extends rearward of and is pivotally coupled with the first leg at a first pivot point;

the second leg comprises a second foot that extends rearward of and is pivotally coupled with the second leg at a second pivot point;

pivoting the first foot relative to the first leg and pivoting the second foot relative to the second leg adjusts a rebound angle of the net relative to a ground engaging surface.

11. The rebounding device according to claim 10, wherein the rebound angle decreases as an angle between the first foot and the first leg decreases.

12. The rebounding device according to claim 1, wherein the net comprises a mesh, wherein the cable is directly coupled to the mesh.

13. The rebounding device according to claim 1, wherein the net comprises a hem provided along at least a portion of the perimeter of the net, wherein the cable extends through the hem.

14. The rebounding device according to claim 1, wherein the perimeter of the net defines a net perimeter shape and wherein the cable path defines a cable path shape that is substantially the same as the net perimeter shape.

15. A rebounding device for sports balls comprising:

a frame defining a frame opening;

a net disposed within said frame opening;

a base member having a first leg and a second leg extending rearward from said frame opening, wherein:

each of the first leg and the second leg is pivotally coupled with the frame such that an angular position of the net is adjustable relative to a ground engaging surface of the base member;

the first leg comprises a first foot that extends rearward of and is pivotally coupled with the first leg at a first pivot point;

the second leg comprises a second foot that extends rearward of and is pivotally coupled with the second leg at a second pivot point;

pivoting the first foot relative to the first leg and pivoting the second foot relative to the second leg adjusts a rebound angle of the net; and the rebound angle decreases as an angle between the first foot and the first leg decreases;

a cable extending around a perimeter of said net and configured to pull said net taut within the frame opening, wherein the cable extends substantially parallel with the perimeter of the net; and a first pivot mechanism and a second pivot mechanism for pivoting the first foot and the second foot between at least a first position and a second position, wherein: in the first position, each of the first foot and the second foot is coplanar with a corresponding one of the first leg and the second leg; and in the second position, each of the first foot and the second foot is disposed at an angle relative to the corresponding one of the first leg and the second leg.

16. The rebounding device according to claim 15, further comprising:

a cable tensioning mechanism configured to tension said cable around the perimeter of said net and thereby pull said net taut within the frame opening.

17. The rebounding device according to claim 16, wherein:

said cable tensioning mechanism includes a rotatable handle for winding said cable onto a drum, and a gear and spring-loaded arm configured to lock said drum into a fixed position.

18. The rebounding device according to claim 16, wherein:

said frame comprises a corner element at each corner of said frame opening;

each said corner element comprises at least one spindle; and said cable extends around said spindle at each corner of said frame opening.

19. The rebounding device according to claim 18, wherein:

a first end of said cable is secured to one of said at least one spindle and a second end of said cable is secured to said cable tensioning system.

20. The rebounding device according to claim 18, wherein:

said corner element includes a first frame member disposed forward of said net and a second frame member disposed rearward of said net; and each of the at least one spindle extends between a respective one of the first frame member and a respective one of the second frame member.

21. A rebounding device for sports balls comprising:

a rigid frame comprising opposing side frame members and an upper frame member extending between the opposing side frame members, wherein the opposing side frame members and the upper frame member define a frame opening;

a net disposed within said frame opening, the net comprising a top side, a bottom side opposite the top side, a left side, and a right side opposite the left side, wherein the top side, bottom side, left side, and right side of the net define a perimeter of the net;

a cable having a first end portion, an opposing second end portion, and a length defined between the first end portion and the second end portion, the entire length of the cable extending along a cable path around the perimeter of said net solely in directions substantially parallel to at least one of the top side, the left side, the right side, or the bottom side of the net; and a cable tensioning system entirely mounted on the rigid frame and configured to tension said cable around the perimeter of said net and thereby pull said net taut within the frame opening along the top side, the bottom side, the left side, and the right side of the net, wherein the first end portion of the cable is connected to, and terminates at, the cable tensioning system and the opposing second end portion of the cable is fixedly attached to, and terminates at, an anchor point on the rigid frame.

22. The rebounding device according to claim 21, wherein the perimeter of the net defines a net perimeter shape and wherein the cable path defines a cable path shape that is substantially the same as the net perimeter shape.

23. The rebounding device according to claim 21, where the cable path is generally rectangular.

* * * * *